United States Patent [19]

Sasaki et al.

[11] Patent Number: 5,024,583

[45] Date of Patent: Jun. 18, 1991

[54] JET PUMP STRUCTURE FOR A FUEL TANK

[75] Inventors: Michiaki Sasaki; Kazuya Yuki, both of Kanagawa, Japan

[73] Assignee: Nissan Motor Co., Ltd., Japan

[21] Appl. No.: 444,791

[22] Filed: Dec. 1, 1989

[30] Foreign Application Priority Data

Dec. 23, 1988 [JP] Japan ..... 63-326429

[51] Int. Cl.[5] ..... F04F 5/46

[52] U.S. Cl. ..... 417/198; 417/194

[58] Field of Search ..... 417/151, 194, 198

[56] References Cited

U.S. PATENT DOCUMENTS

| | | | |
|---|---|---|---|
| 2,953,156 | 9/1960 | Bryant | 137/571 |
| 3,134,338 | 5/1964 | Dodge | 417/194 |
| 4,834,132 | 5/1989 | Sasaki et al. | 417/194 |

FOREIGN PATENT DOCUMENTS

| | | | |
|---|---|---|---|
| 0257834 | 3/1988 | European Pat. Off. . | |
| 2849461 | 2/1987 | Fed. Rep. of Germany . | |
| 3719809 | 6/1988 | Fed. Rep. of Germany . | |
| 57109921 | 12/1955 | Japan . | |
| 197684 | 3/1924 | United Kingdom | 417/194 |
| 274107 | 7/1928 | United Kingdom | 417/194 |

*Primary Examiner*—Leonard E. Smith
*Assistant Examiner*—M. Kocharov
*Attorney, Agent, or Firm*—Leydig, Voit & Mayer

[57] ABSTRACT

A jet pump structure for a fuel tank having first and second chambers therein includes first, second and third fuel pipes all of which are connected to a vacuum chamber provided within the fuel tank. The first pipe returns oversupplied fuel into the vacuum chamber, the second pipe transfers fuel stored in the first chamber into the vacuum chamber, and the third pipe receives the fuel from the first and second pipes. A silencer unit is connected to the third pipe for receiving the fuel from the third pipe and discharging the fuel into the second chamber. A flow guide member is provided within the first pipe receives the oversupplied fuel and forms same a swirl flow. The swirl flow is ejected from the first pipe to provide a vacuum the vacuum chamber.

8 Claims, 2 Drawing Sheets

JET PUMP STRUCTURE FOR A FUEL TANK

BACKGROUND OF THE INVENTION

1. Field of the Invention

The present invention relates generally to a jet pump structure for a fuel tank installed in a vehicle such as an automobile vehicle. More specifically, the present invention relates to a jet pump structure for a fuel tank having first and second fuel chambers therein, wherein fuel stored in the first chamber is effectively transferred to the second chamber using jet swirl flows of return fuel which has been oversupplied to an engine.

2. Description of the Background Art

Recently, there has been a large demand for effective layout of a fuel tank so as to enlarge so-called utility space particularly in a passenger car. To satisfy this demand, there has been a type of the fuel tank which straddles the driving system components or the exhaust system components.

For example, Japanese Utility Model Publication (Jikkai Sho) 57-109921 discloses a fuel tank structure having a bottom wall which projects inwardly so as to avoid interference between the tank bottom wall and other functional parts.

In this type of the fuel tank, however, since a main fuel chamber and an auxiliary fuel chamber are formed at its lower section by the inward projection of the bottom wall, it is necessary to provide an arrangement which prevents the fuel remaining within one of the chambers from not being used. For example, a fuel feed pipe could be bifurcated into the main and auxiliary chambers through a switching valve such that when the fuel stored in the main chamber runs out, the switching valve is actuated to supply the fuel in the auxiliary chamber to the engine.

However, that structure requires the switching valve and other units such as a liquid level gauge and a control unit for actuating the switching valve automatically, which is very costly and complicated.

SUMMARY OF THE INVENTION

Therefore, it is an object of the present invention to provide a jet pump structure for a fuel tank having first and second fuel chambers therein, which effectively transfers fuel stored in the first fuel chamber to the second fuel chamber without using a switching valve and control units, and which further works as a silencer to effectively prevent generation of noise which is otherwise caused due to abrupt expansion of the vapor included in return fuel.

To accomplish the above-mentioned and other objects, according to one aspect of the present invention, a jet pump structure for a fuel tank having first and second fuel chambers therein comprises a vacuum chamber provided within the fuel tank, first means connected to the vacuum chamber for returning oversupplied fuel into the vacuum chamber, second means connected to the vacuum chamber for transferring fuel stored in the first chamber into the vacuum chamber, third means connected to the vacuum chamber for receiving the fuel from the first and second means, fourth means connected to the third means for receiving the fuel from the third means and discharging same into the second chamber, and fifth means provided within the first means for receiving the oversupplied fuel to form same into a swirl flow, the swirl flow being ejected from the first means as a jet swirl flow into the vacuum chamber so as to provide a vacuum therearound within the vacuum chamber, the ejected swirl flow further sealing the vacuum chamber against the third means so as to prevent the vacuum generated within the vacuum chamber from being released through the third and fourth means such that the vacuum effectively sucks the fuel from the first chamber through the second means.

The fourth means includes sixth means for receiving the swirl flow from the third means and providing a gradual pressure reduction to the swirl flow.

The fourth means further includes seventh means provided at the sixth means for smoothly dispersing the pressure reduced swirl flow into the second chamber.

BRIEF DESCRIPTION OF THE DRAWINGS

The present invention will be understood more fully from the detailed description given herebelow and from the accompanying drawings of the preferred embodiment of the invention, which are given by way of example only, and are not intended to limit the present invention.

In the drawings.

DESCRIPTION OF THE PREFERRED EMBODIMENT

Referring now to FIGS. 1 to 5, there is illustrated a preferred embodiment of a jet pump structure 1 according to the present invention.

Figure 3:
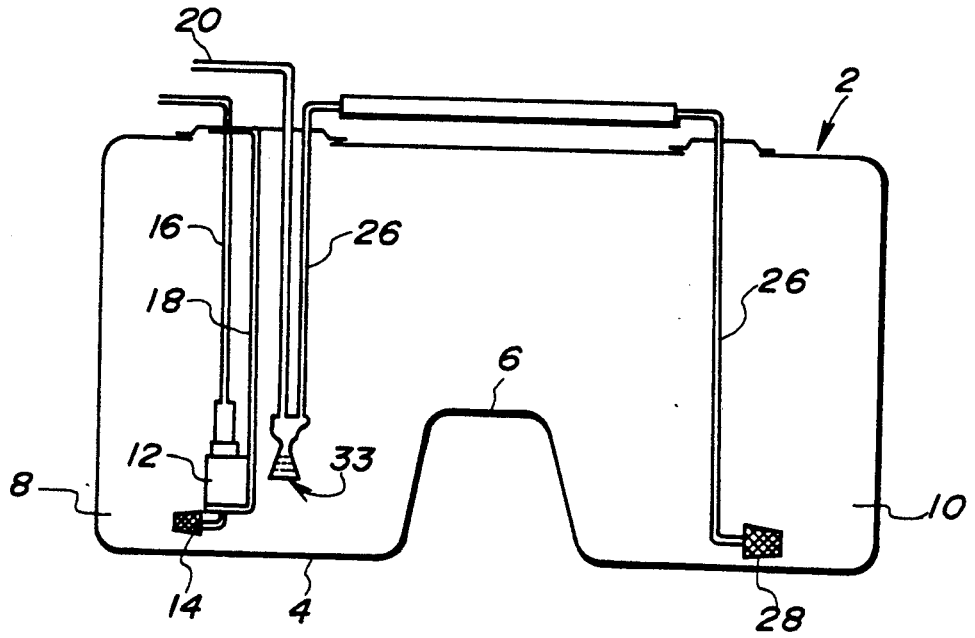
FIG. 3 is a schematic sectional view showing a fuel tank provided with the jet pump structure of FIG. 1.

In FIG. 3, a fuel tank body 2 has a bottom 4 which is formed with an inward projection 6 across the width of the bottom 4. The inward projection 6 defines a main chamber 8 and an auxiliary chamber 10 at the lower portion of the fuel tank body 2.

In the main chamber 8, a fuel feed pump 12 is provided to feed the fuel into the fuel supply system (not shown) through a filter 14 and a fuel feed pipe 16. The fuel feed pump 12 and the filter 14 are fixedly mounted within the tank body 2 by an elongate mounting member 18.

Figure 1:
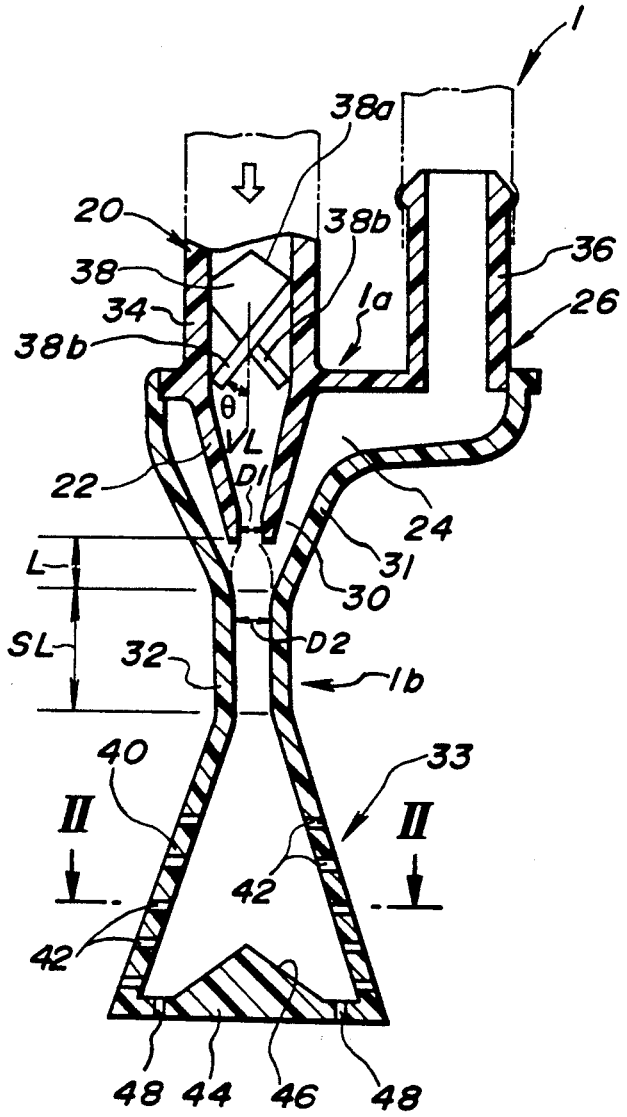
FIG. 1 is a sectional view showing a jet pump structure according a preferred embodiment of the present invention.
Figure 2:
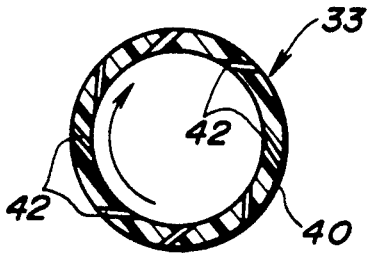
FIG. 2 is a cross-sectional view taken along the line II—II in FIG. 1.

A fuel return pipe 20 is provided in the tank body 2 extending parallel to the fuel feed pipe 16 for recirculating into the fuel tank body 2 the fuel which has been oversupplied to the engine (not shown) via the fuel feed pipe 16. As shown in FIG. 1, the lower end of the fuel return pipe 20 is a tapered nozzle for ejecting the fuel as a jet flow to provide a vacuum around the jet flow.

A fluid-tight chamber 24 is provided encircling the nozzle 22 therebetween. A fuel transfer pipe 26 has a fluid-tight connection to the vacuum chamber 24 for transferring the fuel stored in the auxiliary chamber 10 to the main chamber 8 through a filter 28. The vacuum chamber has a tapered portion 30 at its lower end. The walls 31 of the vacuum chamber 24 defining this tapered portion 30 works as a venturi tube in cooperation with the outer peripheries of the nozzle 22 so as to accelerate the fuel transferred into the vacuum chamber 24 through the transfer pipe 26.

A throat pipe 32 has a fluid-tight connection to the vacuum chamber 24 which just follows the walls 31 defining the tapered portion 30 of the vacuum chamber 24 for receiving the mixture of the fuels introduced from the nozzle 22 and the fuel transfer pipe 26 and discharging same into the main chamber 8 through a silencer unit 33. The silencer unit 33 is located must following the lower end of the throat pipe 32.

In this embodiment, the jet pump structure 1 is constituted by two pump components 1*a* and 1*b*. Specifically, the pump component la includes a return pipe outlet port 34 including the nozzle 22 and a transfer pipe outlet port 36, which are integrally formed altogether. The return pipe outlet port 34 including the nozzle 22 is formed separately from the other portion of the return pipe 20 and the transfer pipe outlet port 36 is separately formed from the other portion of the transfer pipe 26. The pump component 1*b* includes the silencer unit 33, the throat pipe 32 and the walls 31 of the vacuum chamber 24, which are integrally formed altogether. The pump components 1*a* and 1*b* are fixedly connected to each other with fluid-tight connections so as to provide the vacuum chamber 24 around the nozzle 22. Further, the upper ends of the return pipe outlet port 34 and the transfer pipe outlet port 36 can be easily fitted into the other portions of the return pipe 20 and the transfer pipe 26, respectively, so that it is quite simple and easy to assemble the jet pump unit 1 and further to mount it within the fuel tank body 2.

Figure 4:
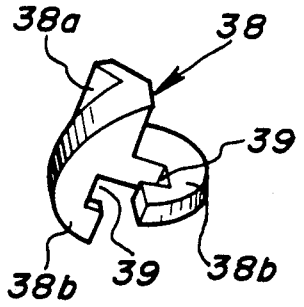
FIG. 4 is a perspective view showing a flow guide member as used in the jet pump structure of FIG. 1.
Figure 5:
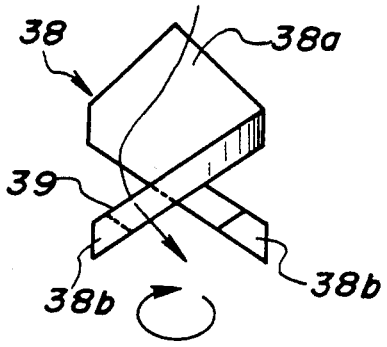
FIG. 5 is a side elevational view showing the flow guide member of FIG. 4.

A flow guide member 38 is provided in the fuel return pipe 20 at the outlet port 34 just above the nozzle 22. As shown in FIGS. 4 and 5, the flow guide member 38 has a base 38*a* and a pair of wings 38*b*. The wings 38*b* extend from opposite sides of the base 38*a* and toward opposite directions at a predetermined angle $\theta$ with respect to the vertical line VL. Each wing 38*b* is similar to a semicircle in shape and an arc of each wing 38*b* is shaped to just follow the corresponding inner wall of the fuel return pipe 20. Each wing 38*b* is formed with a recessed cut-out 39 at its downstream end portion.

As shown in FIG. 1, the flow guide member 38 is fixedly arranged within the outlet port 34 of the fuel return pipe 20 with the base 38*a* positioned upstream of the return fuel flow with respect to the wings 38*b*. The flow guide member 38 receives the fuel returned through the return pipe 20 and guides the fuel into the downstream side through the recessed cut-outs 39 formed at the wings 38*b* to form swirl flows as shown by an arrow in FIG. 5. The swirl flows are then ejected from the nozzle 22. The swirl flows are then diffused to make its swirl radius larger so as to contact the inner wall of the throat pipe 32 at its inlet portion as shown by dotted lines in FIG. 1. The ideal shape of the swirl flows between the lower end of the nozzle 22 and the upper end of the throat pipe 32 is a corn-shape having a circular cross-section, which is shown by the dotted lines in FIG. 1.

By providing the flow guide member 38 in the fuel return pipe 20 just above the nozzle 22, the swirl flows ejected from the nozzle 22 are certain to come into contact with the inner wall of the inlet portion of the throat pipe 32 even if the return fuel flow rate is relatively small so that the vacuum chamber 24 is tightly sealed from the atmospheric pressure through the silencer unit 33 and the throat pipe 32, i.e. from the atmospheric pressure within the fuel tank body 2. Accordingly, the vacuum generated by the jet swirl flows within the vacuum chamber 24 is certain to effectively suck the fuel from the auxiliary chamber 10 through the transfer pipe 26. The sucked fuel which is accelerated through the venturi portion 30 joins the swirl flows and is discharged into the main chamber 8 through the throat pipe 32 and the silencer unit 33.

On the other hand, without the flow guide member 38 provided in the return pipe 20, when the jet flow rate discharged from the nozzle 22 is relatively small, the jet flow radius does not become large enough to contact the inner wall of the throat pipe 32, so that no seal is provided for the vacuum chamber 24 to prime suction of the fuel from the auxiliary chamber 10.

Accordingly, the jet pump structure according to this embodiment ensures effective suction of the fuel from the auxiliary chamber 10 over wide ranges of the return fuel flow rates. Further, the jet pump structure according to this embodiment ensures the rapidly responsive prime suction of the fuel as well as the shortened suction time for a unit amount of the fuel since the vacuum generated within the vacuum chamber 24 effectively sucks the fuel from the auxiliary chamber 10 without being released through the throat pipe 32 and the silencer unit 33.

The silencer includes an expansion chamber 40 which is of a frustoconical shape and is continuous with the throat pipe 32 for receiving the fuel therefrom. The expansion chamber 40 includes in its circumferential wall a plurality of through holes 42 as clearly seen in FIGS. 1 and 2. Each of the through holes 42 establishes communication between the inside of the expansion chamber 40 and the outside thereof and extends in a direction substantially along a swirling direction of the swirl flow (as shown by an arrow in FIG. 2) introduced into the expansion chamber 40 through the throat pipe 32. The expansion chamber 40 includes at the center of its bottom 44 with an inward conical projection 46 and includes with a plurality of through holes 48 around the conical projection 46. Each hole 48 extends vertically and establishes communication between the inside of the expansion chamber 40 and the outside thereof.

The silencer unit 33 structured as above functions as follows:

The return fuel returned through the fuel return pipe 20 tends to include vapor therein particularly when the engine temperature is high, since the return fuel is circulated through the fuel supply system for the engine. When this occurs, the return fuel mixed with the fuel fed through the fuel transfer pipe 26 is introduced into the throat pipe 32 as a vapor-liquid phase flow. Accordingly, when the vapor-liquid phase flow is introduced into the fuel tank body 2 directly through the throat pipe 32, the vapor abruptly expands in the tank body 2 due to the sudden pressure reduction and makes noise. On the other hand, in the embodiment as described above, the vapor-liquid phase fuel flow is first introduced into the expansion chamber 40 before being introduced into the tank body 2. Since the expansion chamber 40 is of a frusto-conical shape, i.e. dimensions of a cross-section of the expansion chamber 40 become gradually larger toward the lower end thereof, the pressure reduction of the vapor also occurs gradually preventing the abrupt expansion of the vapor and the generation of noise. Further, since the through holes 42 each extend in a direction substantially along the swirl direction of the vapor-liquid phase fuel flow, the expanded vapor is smoothly discharged through the holes 42 into the tank body 2 along with the liquid phase fuel. In addition, the holes 42 disperse the fuel to a number of locations within the tank body 2, so that vapor generation caused by agitation of the fuel in the tank body 2 due to the introduction of the swirling vapor-liquid phase flow, is effectively prevented. Still further, the conical projection 46 maintains or increases the a circumferential speed or the peripheral velocity of the introduced swirl flow, so that the stagnation of the fuel within the expansion chamber 40 is also effectively prevented.

It is to be noted that, for satisfying a required minimum flow rate of the fuel from the auxiliary chamber 10 into the main chamber 8 under all the engine operating conditions, various values have been selected as follows:

| | |
|---|---|
| $\theta$ | 30° to 60° |
| D1 | 1.2 mm to 1.5 mm |
| SL | 5 mm to 20 mm |
| L | not more than 4 mm |
| D2/D1 | 1.4 to 3.2 |

(wherein $\theta$ is an angle of each wing 38*b* with respect to the vertical line, VL, D1 is the inner diameter of the nozzle 22, SL is the length of the throat pipe 32, L is the length of the clearance between the lower end of the nozzle 22 and the upper end of the throat pipe 32, and D2/D1 is the ratio of the throat pipe inner diameter to the nozzle inner diameter).

These values have been selected in the light of the following conditions.

As mentioned above, the ideal shape of the jet swirl flows between the lower end of the nozzle 22 and the upper end of the throat pipe 32 is a corn-shape having a circular cross-section. Specifically, this shape ensures a secure liquid seal for the vacuum chamber 24 against the atmospheric pressure through the throat pipe 32 to provide the rapidly responsive prime suction of the fuel from the auxiliary chamber 10 through the transfer pipe 26 and further ensures the smooth and responsive transfer of the sucked fuel into the main chamber 8 through the throat pipe 32 after the prime suction of the fuel, over wide ranges of return fuel flow rates. However, when the return fuel flow rate is minimum, the cross section of the corn-shaped swirl flows tends not to be circular. The angle $\theta$ has been selected to ensure the circular cross section of the swirl flows even under such a minimum flow rate. Specifically, when the angle $\theta$ is smaller than the selected values, the liquid seal of the vacuum chamber 24 is weakened so that the atmospheric pressure is introduced into the vacuum chamber 24 through the throat pipe 32 to reduce the jet pump effect. On the other hand, when the angle $\theta$ is larger than the selected values, the back pressure from the flow guide member 38 adversely affects the injection valves of the engine and makes the engine speed unstable. Accordingly, the maximum value of the angle $\theta$ has been selected such that the back pressure from the flow guide member 38 is equal to the back pressure from the injection valves. The selected minimum and maximum values have been selected as the practical lower and upper limits considering the values of the other elements.

The return fuel flow rate is determined by the difference between the fuel discharge rate of the feed pump 12 and actual engine consumption. Specifically, when the engine load is small such as at engine idling, the return fuel flow rate is large, while when the engine load or speed is high, the return fuel flow rate is small. Further, when the engine temperature is high, as mentioned before, the return fuel tends to become a vapor-liquid phase flow. Accordingly, the return fuel flow rate varies widely depending on the engine operating conditions. Actual operating data which cover wide ranges of the engine operating conditions as well as of the fuel nature, have revealed that the minimum return fuel flow rate is 30 l/h.

On the other hand, the transfer flow rate of the fuel from the auxiliary chamber 10 to the main chamber 8 should satisfy the following formula since the fuel stored in the auxiliary chamber 10 should be consumed first.

$$Q2 \geqq QE \cdot V2/(V1+V2)$$

(wherein, Q2 is the fuel transfer flow rate (l/h) from the auxiliary chamber 10, QE is the engine fuel consumption (l/h), V1 is the volume of the main chamber 8 (l), V2 is volume of the auxiliary chamber 10 (l)).

The fuel tank actually installed in cars currently generally has 40 l to 70 l volume. Accordingly, the volume of the main chamber 8 to that of the auxiliary chamber 10 should be at least 1:1 since the main chamber 8 is provided therein with the feed pump 12. Under these conditions, it has been confirmed that the minimum transfer fuel flow rate Q2 should be 8 l/h so as to prevent an absence of the fuel to be supplied to engine with the fuel still remaining within the auxiliary chamber 10, during the normal engine operation.

The selected values D1, SL, L and D2/D1 as mentioned above are the optimum values which satisfy the required minimum transfer fuel flow rate Q2 under the minimum return flow rate. Specifically, when the inner nozzle diameter D1 exceeds 1.5 mm, the transfer fuel flow rate Q2 becomes less than 8 l/h, and when the inner nozzle diameter D1 is less than 1.2 mm, the nozzle 22 tends to be choked with dust. Accordingly, the values 1.2 mm and 1.5 mm have been selected as the practical lower and upper limits.

When the length of the throat pipe 32 SL is less than 5 mm, the required minimum transfer fuel flow rate 8 l/h can not be attained with the fuel at a room temperature. With room temperature fuel, as the length SL gets longer, the jet pump effect gets larger. However, when the fuel temperature becomes higher, to around 80° C., by the heat transmitted from the engine, vacuum ebullition occurs in the swirled fuel ejected from the nozzle 22 so that vapor is generated which narrows the liquid flow path in the throat pipe 32 making the fuel transfer difficult. In the light of this result, the length SL can not exceed 20 mm. Accordingly, the values of 5 mm and 20 mm have been selected as practical lower and upper limits.

When the length of the clearance L is 4 mm, the required minimum transfer fuel flow rate (8 l/h) is attained even under the minimum return fuel flow rate (30 l/h). On the other hand, when the length L exceeds 4 mm, such as 6 mm or 8 mm, the required minimum transfer flow rate Q2 can not be obtained at the minimum return fuel flow rate. Accordingly, the value 4 mm has been selected as the practical upper limit.

When the ratio of the inner throat pipe diameter to the inner nozzle diameter D2/D1 is less than 1.4 or larger than 3.2, the required minimum transfer flow rate (8 l/h) can not be attained at the minimum return fuel flow rate (30 l/h). Accordingly, the values 1.4 and 3.2 have been selected as practical lower and upper limits.

As understood from the above description, since the aforementioned selected values have been determined to provide the required minimum transfer flow rate Q2 (8 l/h) even at minimum return flow rate (30 l/h), the jet pump structure ensures smooth and secure fuel transfer from the auxiliary chamber to the main chamber under all the engine operating conditions to prevent the absence of the fuel in the main chamber to be supplied to the engine with fuel still remaining within the auxiliary chamber.

It is to be understood that the invention is not to be limited to the embodiments described above, and that various changes and modifications may be made without departing from the spirit and scope of the invention as defined in the appended claims.

What is claimed is:

1. A jet pump structure for a fuel tank having first and second chambers therein comprising:

a vacuum chamber provided within the fuel tank;

first means, connected to said vacuum chamber, for returning oversupplied fuel to said vacuum chamber;

second means, connected to said vacuum chamber, for transferring fuel from the first chamber into said vacuum chamber;

third means, connected to said vacuum chamber, for receiving fuel from said first and second means;

fourth means, connected to said third means, for receiving fuel from said third means and discharging fuel into the second chamber; and fifth means, provided with said first means, receiving the returning oversupplied fuel for forming the returning oversupplied fuel into a swirl flow of fuel, said swirl flow of fuel being ejected from said first means as a jet swirl flow of fuel into said vacuum chamber and forming a vacuum around said first means within said vacuum chamber, said ejected swirl flow of fuel sealing said vacuum chamber relative to said third means and preventing the vacuum generated within said vacuum chamber from being released through said third and fourth means, such that the vacuum effectively sucks fuel from the first chamber through said second means, said fourth means including an expansion chamber having a frusto-conical shape including a tapered circumferential side wall extending from an open top of relatively small area to a bottom wall of a relatively large area, connected at said top to said third means for receiving the swirl flow of fuel from said third means, for providing a gradual pressure reduction to the swirl flow of fuel, and including a plurality of through holes in said circumferential side wall, each of said through holes extending substantially along a swirling direction of the swirl flow of fuel for discharging fuel into the second chamber.

2. A jet pump as set forth in claim 1 wherein said bottom wall of said expansion chamber includes a centrally located inward conical projection.

3. A jet pump structure for a fuel tank having first and second chambers therein comprising:

a vacuum chamber provided within said fuel tank;

a fuel return pipe connected to said vacuum chamber for returning oversupplied fuel to said vacuum chamber, said fuel return pipe having a tapered portion at its lower end forming a nozzle for ejecting returned oversupplied fuel into said vacuum chamber;

a fuel transfer pipe connected to said vacuum chamber for transferring fuel from the first chamber into said vacuum chamber;

a throat pipe having an inner wall and an inlet connected to said vacuum chamber for receiving fuel from said fuel return pipe and said fuel transfer pipe;

silencer means, connected to said throat pipe, for receiving fuel from said throat pipe and discharging fuel into the second chamber; and a flow guide member provided within said fuel return pipe, said flow guide member receiving the returning oversupplied fuel for forming the returning oversupplied fuel into a swirl flow of fuel, said swirl flow of fuel being ejected from said nozzle as a jet swirl flow of fuel into said vacuum chamber and forming a vacuum around said fuel return pipe within said vacuum chamber, said ejected swirl flow of fuel contacting an inner wall of said throat pipe at said inlet and sealing said vacuum chamber relative to said throat pipe to prevent the vacuum within said vacuum chamber from being released through said throat pipe and said silencer means so that the vacuum effectively sucks fuel from the first chamber through said fuel transfer pipe, said silencer means including an expansion chamber having a frusto-conical shape including a tapered circumferential side wall extending from an open top of relatively small area to a bottom wall of relatively large area, connected at said top to said throat pipe for receiving the swirl flow of fuel from said throat pipe, for providing a gradual pressure reduction to the swirl flow of fuel, and including a plurality of through holes in said circumferential side wall, each of said through holes extending substantially along a swirling direction of the swirl flow of fuel for discharging fuel into the second chamber.

4. A jet pump as set forth in claim 3, wherein said bottom wall of said expansion chamber includes a centrally located inward conical projection.

5. A jet pump structure as set forth in claim 4, wherein said bottom wall of said expansion chamber includes a plurality of through holes adjacent said inward conical projection.

6. A jet pump structure as set forth in claim 2 wherein said bottom wall of said expansion chamber includes a plurality of through holes adjacent said inward conical projection.

7. A jet pump structure as set forth in claim 1 wherein said through holes are arranged at substantially equal intervals around said circumferential side wall of the expansion chamber.

8. A jet pump structure as set forth in claim 3 wherein said through holes are arranged at substantially equal intervals around said circumferential side wall of the expansion chamber.

* * * * *